US007510207B2

(12) United States Patent
Resch et al.

(10) Patent No.: US 7,510,207 B2
(45) Date of Patent: Mar. 31, 2009

(54) SKI BINDING WITH A POSITIONING AND FIXING MECHANISM FOR THE JAW BODIES

(75) Inventors: Franz Resch, Schladming (AT); Helmut Holzer, Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 301 days.

(21) Appl. No.: 11/488,472

(22) Filed: Jul. 18, 2006

(65) Prior Publication Data

US 2007/0126205 A1 Jun. 7, 2007

(30) Foreign Application Priority Data

Jul. 19, 2005 (AT) ..... A 1209/2005

(51) Int. Cl.
*A63C 9/00* (2006.01)

(52) U.S. Cl. ..... 280/617; 280/613; 280/616; 280/618; 280/620; 280/14.22; 280/14.23

(58) Field of Classification Search ..... 280/613, 280/616, 617, 618, 620, 14.22, 14.23
See application file for complete search history.

(56) References Cited

U.S. PATENT DOCUMENTS

| | | | | |
|---|---|---|---|---|
| 3,248,124 | A * | 4/1966 | Tiesler | 280/617 |
| 3,635,485 | A * | 1/1972 | Gertsch et al. | 280/617 |
| 4,871,186 | A * | 10/1989 | Klosterman | 280/611 |
| 5,085,453 | A * | 2/1992 | Bildner | 280/612 |
| 5,211,417 | A * | 5/1993 | Klaus et al. | 280/617 |
| 5,261,688 | A | 11/1993 | Rohrmoser | |
| 5,344,178 | A | 9/1994 | Rohrmoser | |

(Continued)

FOREIGN PATENT DOCUMENTS

DE 20 44 786 3/1972

(Continued)

OTHER PUBLICATIONS

Office Action in Austrian Application A 1209/2005.

*Primary Examiner*—Christopher P Ellis
*Assistant Examiner*—Jacob Meyer
(74) *Attorney, Agent, or Firm*—Collard & Roe, P.C.

(57) ABSTRACT

The invention describes a ski binding (1), with guide elements (8, 9) which can be mounted or pre-fitted on a ski (3) in the binding longitudinal direction (10), for a front and a rear jaw body (4, 5). A first coupling element (15) is connected to the front jaw body (4) and a second coupling element (16) is connected to the rear jaw body (5). Mutually facing end portions (17, 18) of these coupling elements (15, 16) co-operate with a positioning and fixing mechanism (14) disposed between the jaw bodies (4, 5) in order to adjust and retain the jaw body (4, 5) as necessary. An overlap width (19) between the two coupling elements (15, 16) can be varied to make an individual adjustment for different jaw distances (12). At least one coupling element (15, 16) is provided with at least two mutually parallel rows (21, 22, 23) of positioning elements (20), and these positioning element-rows (21, 22, 23) are disposed offset from one another in the binding longitudinal direction (10). An offset distance (24) between adjacent rows (21, 22; 22, 23) of positioning elements (20) represents a step dimension for an overlap step width between the coupling elements (15, 16).

23 Claims, 7 Drawing Sheets

U.S. PATENT DOCUMENTS

| | | | | |
|---|---|---|---|---|
| 6,056,310 | A * | 5/2000 | Hangl | 280/607 |
| 6,189,911 | B1 * | 2/2001 | Caron et al. | 280/607 |
| 6,217,055 | B1 * | 4/2001 | Silva | 280/607 |
| 6,315,318 | B1 * | 11/2001 | Caron et al. | 280/617 |
| 6,431,578 | B2 * | 8/2002 | Pedersen et al. | 280/626 |
| 6,471,235 | B1 | 10/2002 | Luitz et al. | |
| 6,840,531 | B2 * | 1/2005 | Gorza et al. | 280/617 |
| 6,848,704 | B2 * | 2/2005 | Lucas | 280/613 |
| 6,935,651 | B2 * | 8/2005 | Krumbeck et al. | 280/616 |
| 7,275,757 | B2 * | 10/2007 | Hoesl et al. | 280/617 |
| 7,284,767 | B2 * | 10/2007 | Himmetsberger et al. | 280/617 |
| 7,431,310 | B2 * | 10/2008 | Redor et al. | 280/11.14 |
| 2003/0155744 | A1 * | 8/2003 | Gorza et al. | 280/618 |
| 2004/0056451 | A1 * | 3/2004 | Baikhardt | 280/618 |
| 2005/0116444 | A1 * | 6/2005 | Himmetsberger et al. | 280/617 |

FOREIGN PATENT DOCUMENTS

| | | |
|---|---|---|
| DE | 35 23 058 | 1/1987 |
| DE | 82 01 007 | 5/1989 |
| DE | 41 35 899 | 6/1992 |
| DE | 100 39 816 | 3/2001 |

* cited by examiner

SKI BINDING WITH A POSITIONING AND FIXING MECHANISM FOR THE JAW BODIES

CROSS REFERENCE TO RELATED APPLICATIONS

Applicant claims priority under 35 U.S.C. §119 of AUSTRIAN Patent Application No. A 1209/2005 filed on Jul. 19, 2005.

BACKGROUND OF THE INVENTION

1. Field of the Invention

The invention relates to a ski binding with guide elements which can be mounted or re-fitted on a ski oriented in the binding longitudinal direction for a front and a rear jaw body, of the type specified in claim 1.

2. Prior Art

Binding manufacturers, hire shops and users have long sought means of adjusting a ski binding or adapting a ski biding to respective shoe sizes rapidly and comfortably. On this subject, reference may be made to the ski binding disclosed in patent specification DE 35 23 058 A1. It describes a ski binding with an adjusting mechanism provided in one of the jaw bodies, in particular the front jaw, by means of which the entire jaw unit comprising both jaw bodies can be fixed in different positions in the ski longitudinal direction on the one hand and the jaw distance can also be adjusted to the respective shoe sizes by means of this adjusting mechanism on the other hand. Accordingly, the heel jaw is coupled with the adjusting mechanism in the front jaw body by means of a strip-shaped connecting element. The disadvantage of this is that the adjusting mechanism in the front jaw must be made to a larger volume and the operating lever for the adjusting mechanism has to be moved into two different positions in order to be able to change the jaw distance or in order to be able to set the relative position of the binding unit with respect to the ski. This means that the user or operator of the ski has to concentrate more.

Patent specification DE 41 35 899 A1 discloses a ski binding, in which the two jaw bodies for retaining the toe-end and heel-end terminal portion of the sports shoe are accommodated and guided in longitudinal guides. Disposed between the front and the rear jaw body is a length adjusting mechanism for individually adjusting the jaw distance. The embodiments of the length adjusting mechanisms described enable either a synchronous coupled movement to be defined between two strip-shaped connecting elements to the jaw bodies or, alternatively, enable the jaw bodies to be moved independently of one another. A longitudinal positioning mechanism for this central length adjusting mechanism positions the length adjusting mechanism in at least one relative position by reference to the ski longitudinal direction. In the case of the embodiments where the two jaw bodies can be moved relative to the ski in the uncoupled state, small steps or toothed strips with relatively fine toothing are needed to enable small adjustment step widths for the jaw bodies.

Patent specification DE 100 39 816 A1 also discloses a ski binding, the jaw bodies of which are fitted so that they can be adjusted in longitudinal guides permanently secured to the ski if necessary. In this instance, mutually facing strip-shaped or strap-like connecting elements on each of the two jaw bodies co-operate with a positioning and fixing mechanism for the connecting elements disposed between the longitudinal guides. Complementary teeth on the mutually facing end portions of the connecting elements which can be moved into engagement with one another are intended to assist the process of fixing the respective distance needed between the two jaw bodies and prevent slipping as far as possible. In order to obtain sufficiently small adjustment step widths, fine teeth are provided with small tooth-to-tooth distances. In one alternative embodiment, it is proposed that an integral connecting element be provided between the jaw bodies and, by means of several orifices spaced at a distance apart from one another in the integral connecting element in the binding longitudinal direction in combination with a matching projection on the central positioning and fixing mechanism, the unit comprising the front jaw body, the integral connecting element and the rear jaw body can be positioned on a stepped basis by reference to the ski and binding longitudinal direction. However, the finely spaced teeth used to obtain small adjustment step widths make it difficult to adjust the jaw body to the respective desired positions.

SUMMARY OF THE INVENTION

The underlying objective of the present invention is to propose a ski binding, by means of which the distance between the front jaw body and the rear jaw body for adapting to the respective shoe size can be adjusted and varied rapidly and comfortably but this ski binding should nevertheless be reliable in terms of preventing any undesired or intentional movements of the jaw body relative to the ski.

This objective is achieved by the ski binding on the basis of the characterizing features defined in claim 1. One advantage obtained as a result of the characterizing features defined in claim 1 is that the individual positioning elements may be made with relatively generous dimensions, whilst nevertheless enabling a finely stepped adjustment and a small adjustment step width. The mutually offset disposition of the positioning elements also imparts a degree of strength and operational reliability to the positioning and fixing mechanism because it is also able to withstand extreme forces without giving rise to problems. In particular, the coupling elements absorb high tensile forces in their end portions in spite of a plurality of positioning elements. Another advantage is the fact that adjustment and re-adjustment operations using the positioning and fixing mechanism are made easier because the positioning elements needed to achieve them can be made with a relatively large structural volume, as a result of which the adjustment operation is relatively easy to perform and the correct one of the plurality of positioning elements can be selected effortlessly and in particular without choosing the wrong one.

The advantage of the embodiment defined in claim 2 is that the ski binding can either be secured to the ski centrally with respect to a binding center point provided by the ski manufacturer or alternatively, the binding unit can be easily slid forwards or in the direction towards the rear relative to the binding center point provided. Another advantage is that only a single locking or fixing element is needed in order to release the two jaw bodies simultaneously to re-position them and then lock them again.

Another embodiment defined in claim 3 is of advantage because the structural height of the coupling elements can be made particularly short in their overlapping portion, given that the structural height is defined by nothing more than the respective thickness or width of the connecting elements in their overlapping portion. Furthermore, it is easy and inexpensive to produce a plurality of orifices and orifices are ideal in terms of the mechanical strength and mechanical robustness which can be achieved. Another particular advantage is the fact that a perfectly light and unobstructed relative movement is made possible between the released coupling elements because the coupling elements can barely cause any obstruction in their overlapping portion, even in opposite adjustment directions.

As opposed to a friction-fit coupling or fixing, the embodiment defined in claim 4 guarantees a particularly reliable and stable retaining system for the jaw bodies in the respective desired positions.

The embodiments defined in claims 5 or 6 provide a robust, durable and perfectly serviceable positioning and fixing mechanism. Furthermore, the way in which a positioning and fixing mechanism operates is perfectly obvious to any user.

The advantage of the embodiment defined in claims 7 and 8 is that the positioning and fixing mechanism is permanently forced into a position in which it locks and secures a jaw body, thereby reliably preventing the jaw body from unintentional shifting movements which might cause a fall or lead to accidents.

The advantage of the embodiment defined in claims 9 and 10 is that only one adjustably mounted fixing element is needed to fix the jaw body in the respective desired relative position which can be selected or used. This keeps the number of parts needed to make the ski binding to a minimum.

Also of advantage is another embodiment defined in claim 11, whereby a fixing element which is structurally small and difficult to access can be effortlessly activated and de-activated by a user of the ski binding. This is particularly the case even under difficult conditions or if it is necessary to wear gloves.

Also of advantage is another embodiment defined in claims 12 and 13, which enables high spring forces to be used so that the fixing mechanism can be reliably forced into its active position. The user of such a ski binding can nevertheless operate the positioning and fixing mechanism effortlessly and above all without tools, because the levering action of the operating element reduces the amount of force which the user has to apply in order to move it. Furthermore, the operating element provided in the form of a lever is easy and comfortable to take hold of.

The advantage of the embodiment defined in claim 14 is that anybody can see immediately whether the positioning and fixing mechanism is in an active or an inactive state. The operating element is also able to assume a top dead center position in which the operating element extending upwards and projecting too far upwards mechanically blocks and prevents the action of stepping into the ski binding and use of the ski.

The advantage of the embodiment defined in claim 15 is that an upward pivoting movement of the operating element and unintentional de-activation of the positioning and fixing mechanism can be reliably prevented when a ski shoe is inserted in the ski binding, and inadvertent de-activation of the positioning and fixing mechanism can be virtually ruled out.

The advantage of the embodiment defined in claim 16 is that the inactive position of the positioning and fixing mechanism is visually obvious to everybody, making it impossible or at least very difficult to step into the ski binding.

The advantage offered by the embodiment defined in claim 17 is that it prevents icing or excessive accumulation of snow inside the positioning and fixing mechanism and at the same times imparts an attractive appearance to the positioning and fixing mechanism.

The embodiment defined in claim 18 is of advantage because the two jaw bodies can be retained and positioned in different positions whilst maintaining their respective jaw distance.

The advantage of the embodiment defined in claims 19 and. 20 is that even an inexperienced user or operator of the ski binding will be able to adjust to the required jaw distance easily and without making a mistake.

As a result of the embodiment defined in claim 21, the operator and user of the ski binding is able to see the respective jaw distance unequivocally as well as the respective relative position of the ski binding unit with respect to the ski and with respect to the binding center point.

The embodiment defined in claim 22 is of advantage because the positioning and fixing mechanism is able to withstand forces acting on it without any problem and a stable and simple mounting is provided for the fixing element of the coupling elements.

As a result of the structural features defined in claim 23, the pin or bolt mounted in a tongue arrangement is mounted so that it is particularly stable in its locking active position and is prevented from shifting.

The advantage offered by the embodiment defined in claim 24 is that the sliding forces applied by the coupling elements to the jaw bodies and by the jaw bodies to the coupling elements are transmitted at the center or centrally, so that the relative displacements or compensating movements of the jaw bodies with respect to the longitudinal guides, such as occur when the ski deforms during use of the ski binding for example, are detrimentally affected as little as possible. Furthermore, due to the overlap and the overlapping disposition of at least certain portions of the mutually facing end portions, relatively wide, strip-shaped coupling elements may be provided, enabling relatively large positioning elements of stable dimensions to be provided as well as an arrangement of several rows of such positioning elements without any problem.

Finally, the features defined in claim 25 are also of advantage because they provide a simple and reliable way of preventing the ski binding and the ski from being used if the jaw bodies of the ski binding are not locked. This significantly enhances safety with respect to use of the ski binding. In particular, incorrect manipulations of the ski binding and unfinished or careless adjustment operations of the positioning and fixing mechanism can not lead to accidents.

BRIEF DESCRIPTION OF THE DRAWINGS

The invention will be described in more detail below with reference to examples of embodiments illustrated in the appended drawings. Of these.

DETAILED DESCRIPTION OF PREFERRED EMBODIMENTS

Figure 1:
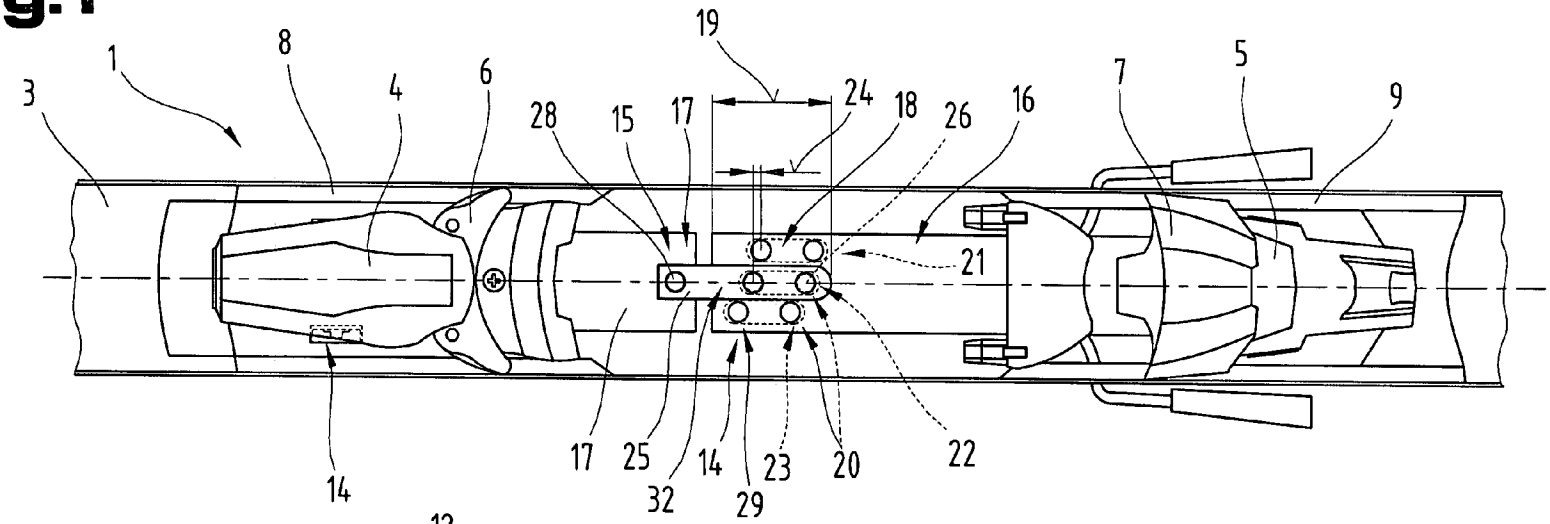
FIG. 1 is a simplified, schematic plan view showing a ski binding with a positioning and fixing mechanism disposed between the front and the rear jaw body.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
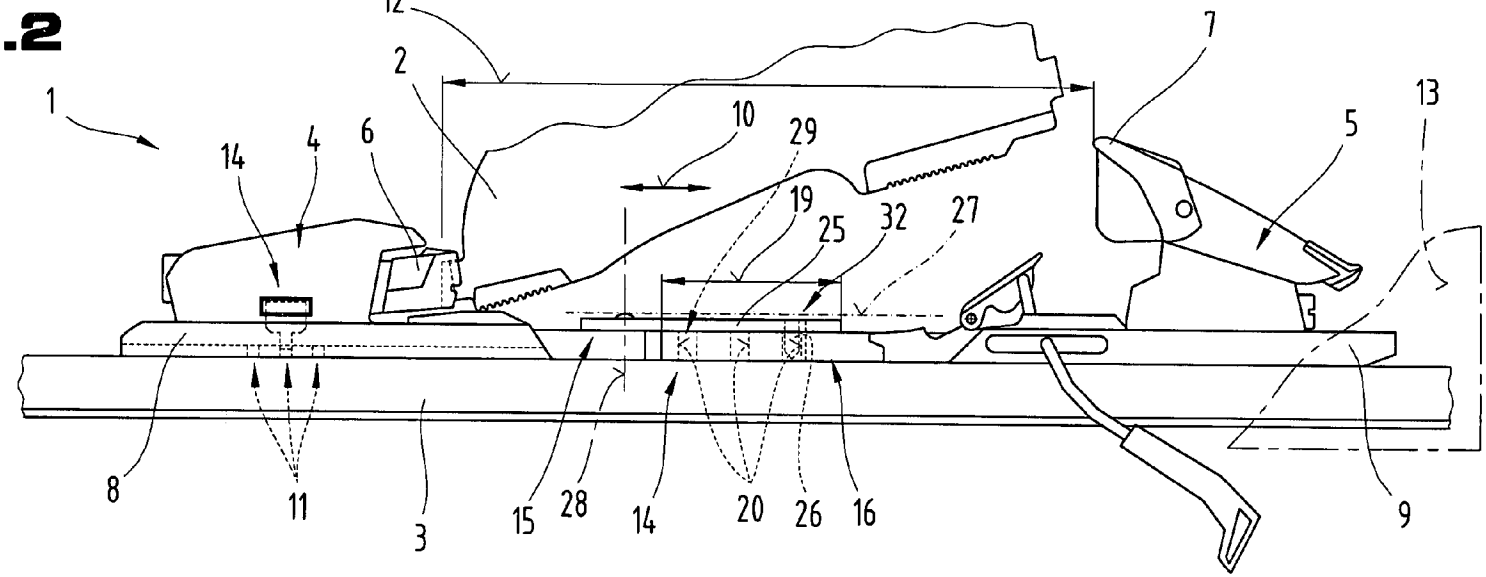
FIG. 2 is a simplified, schematic side view of the ski binding illustrated in FIG. 1.

FIGS. 1 and 2 illustrate a ski binding 1, in particular a safety ski binding, for releasably connecting a sports shoe 2 to a board-type gliding device, in particular to a ski 3. Since the ski binding 1 is designed as a safety ski binding, the sports shoe 2 is released from the ski binding 1 or from the ski 3 in a known manner if stress which is critical to safety or dangerous to the health occurs. The appropriate limit or threshold values for automated release of the sports shoe 2 on the ski binding 1 can be adjusted in a manner known per se, due to the fact that the spring or biasing force of resilient elastic means or force storing means are designed so that they can be adjusted. However, the ski binding 1 is not restricted solely to applications involving a safety binding and it is also possible to use rigid retaining elements for a sports shoe 2, e.g. in the form of so-called buckle bindings or similar, in conjunction with a ski binding 1 of the generic type.

In any event, the ski binding 1 is designed so that the user is able to couple his sports shoe 2 with the ski 3 whenever necessary and can release this coupling connection again as and when necessary.

The ski binding 1 comprises a front jaw body 4 for retaining the front or toe-end portion of a sports shoe 2 and a rear jaw body 5 for retaining the rear or heel-end portion of a sports shoe 2. These jaw bodies 4, 5 comprise sole holders 6, 7 for the sole of a sports shoe 2 inserted in the ski binding 1 and optionally force storage means or spring means for retaining the sole holder 6, 7 with a defined and optionally adjustable retaining force by reference to the ready or fitted position of the sole holders 6, 7.

The jaw bodies 4, 5 are respectively accommodated and retained in cooperating longitudinal guides 8, 9 permanently attached to the ski so that they are able to slide longitudinally. In particular, a guide track for the jaw bodies 4, 5 extends along the longitudinal guides 8, 9 parallel with the binding longitudinal direction—indicated by arrow 10—and parallel with the longitudinal direction of the ski 3. However, these longitudinal guides 8, 9 prevent any sliding movements of the jaw body 4 in all directions extending transversely to the binding longitudinal direction 10.

In the embodiment illustrated as an example in FIGS. 1 and 2, the front jaw body 4 is also secured or held fast with respect to its longitudinal guide 8 in the direction of the binding longitudinal axis 10. The front jaw body 4 is therefore preferably fixed in one of several possible positions by reference to the binding longitudinal direction—indicated by arrow 10—with respect to the longitudinal guide 8 co-operating with it. To this end, at least two but preferably several freely selectable locking positions 11 are provided for the front jaw body 4 spaced at a distance apart from one another in the binding longitudinal direction—indicated by arrow 10. By means of these freely selectable locking positions 11 for the front jaw 4, the relative position of the ski binding 1 relative to the ski 3 can therefore be selected or adjusted and an appropriate jaw distance 12 between the front jaw body 4 and the rear jaw body 5 matching the sports shoe 2 can be selected and set, to enable the ski binding 1 to be adapted to the respective shoe size or shoe sole length. The rear jaw body 5 preferably remains in its longitudinal guide 9 so that it is able to slide freely and this rear jaw body 5 is connected—in a manner known per se—via a largely non-expanding connecting element to the front jaw body 4 and to the ski 3. This tongue-like connecting element, which may optionally also be elastically deformable within a vertical plane 13, thus positions the rear jaw body 5 so that it can slide freely in the rear longitudinal guide 9.

The ski binding 1 also has at least one positioning and fixing mechanism 14, by means of which the non-operating or usage position of the front and/or rear jaw body 4, 5 can be set and fixed relative to the ski 3 and relative to the longitudinal guides 8, 9 permanently attached to the ski as and when necessary. In the case of the embodiment illustrated as an example in FIGS. 1 and 2, two separate positioning and fixing mechanisms 14 are provided, the first positioning and fixing mechanism 14 being used to fix the relative position of the front jaw body 4, whilst the second positioning and fixing mechanism 14 can be used to individually adjust the relative position of the rear jaw body 5 with respect to the ski 3 and with respect to the respective longitudinal guides 8, 9 within defined adjustment ranges. As will be explained below, it is also advantageously possible to provide a single central positioning and fixing mechanism 14, by means of which the relative positions for the front and also the rear jaw bodies 4, 5 can be changed and fixed relative to the ski 3 as and when necessary.

A positioning and fixing mechanism 14 of this type is positioned between the front jaw body 4 and the rear jaw body 5. This positioning and fixing mechanism 14 disposed between the front and rear jaw bodies 4, 5 is provided at least as a means of adjusting and maintaining the set jaw distance 12 needed for the respective sports shoe 3.

The generic ski binding 1 also has a first coupling element 15 connected to the front jaw body 4 and a second coupling element 16 connected to the rear jaw body 5. These coupling elements 15, 16 are preferably strip-shaped or bar-shaped or conform to some other section shape and have tension-resistant and expansion-resistant properties with respect to the forces which occur during use of the ski binding 1. Mutually facing and adjacently lying end portions 17, 18 of the coupling elements 15, 16 are used as a means of positioning and retaining by a tongue-like arrangement the front and rear jaw bodies 4, 5 in their longitudinal guides 8, 9 starting from a central part-portion between the front and rear jaw bodies 4, 5. The mutually facing end portions 17, 18 of the coupling elements 15, 16 thus constitute a component part or functionally relevant parts of the positioning and fixing mechanism 14. Above all, in view of the intended function of the positioning and fixing mechanism 14, the mutually facing end portions 17, 18 of the coupling elements 15, 16 must cooperate in such a way that they can be variably fixed with respect to the positioning and fixing mechanism 14. In particular, the mutually facing end portions 17, 18 of the two coupling elements 15, 16 co-operate with the positioning and fixing mechanism 14 disposed between the jaw bodies 4, 5 in such a way that the position of the rear jaw body 5 and/or the position of the front jaw body 4 can be individually defined and fixed relative to the ski 3.

In the embodiment illustrated as an example in FIGS. 1 and 2, the front jaw body 4 is positioned by means of a positioning and fixing mechanism 14 provided separately for it in the direction of the binding longitudinal direction 10. The other jaw body 5 is held in position by means of the additional, central positioning and fixing mechanism 14 relative to the front jaw body 4 at a jaw distance 12 matching the sports shoe 2, and this rear jaw body 5 remains relatively displaceable and is able to slide relative to its longitudinal guide 9 and relative to the ski 3 when the ski is subjected to bending movements or flexing. Tensions between the ski binding 1 or the sports shoe 2 inserted in it and the ski 3 can therefore be reduced or minimized.

The positioning and fixing mechanism 14 for at least one of the jaw bodies 4, 5—in the embodiment illustrated as an example in FIGS. 1 and 2 for the rear jaw body 5—connects the mutually facing end portions 17, 18 of the coupling elements 15, 16 with a variably adjustable overlap, to permit an adjustment and free-sliding retaining system for at least one of the jaw bodies 4, 5 as necessary by reference to the binding longitudinal direction 10. The coupling elements 15, 16 therefore overlap in the region of the positioning and fixing mechanism 14, and this overlap of the coupling elements 15, 16 is achieved in such a way that their end portions 16, 17 lie one on top of the other. In particular, the bottom face of the first coupling elements 15 in the corresponding overlap zone lies on the top face of the second coupling element 16. Naturally, the reverse arrangement would also be possible. The selected or requisite overlap width 19 between the end portions 17, 18 of the two coupling elements 15, 16 is therefore decisive for the respective jaw distance 12 between the jaw bodies 4, 5. In particular, the jaw distance 12 varies depending on the overlap width 19 so that the ski binding 1 can be individually adjusted or adapted to whatever shoe size or shoe sole length is necessary.

At least one end portion 17, 18 on at least one of the coupling elements 15, 16 has a plurality of positioning elements 20 for changing the overlap width 19 in steps. Accordingly, the disposition and/or orientation of the positioning elements 20 is selected so that the step widths and the available steps in the overlap width 19 conform to existing size differences of a shoe size standard or the steps of a standardized variation in length for shoe soles. In particular, the adjustable step stages on the positioning and fixing mechanism 14 by reference to the overlap width 19 correspond to the changes in length of a standard shoe sole for a co-operating ski shoe or sports shoe 2. The available step stages or step lengths are therefore defined by the disposition in rows and the corresponding spacing of the positioning elements 20. This stepped or staggered variability or adjustability of the overlap width 19 is preferable to a stepless adjustability of the overlap width 19. In particular, by dimensioning the layout or structural disposition of the positioning elements 20 accordingly, a situation can be prevented in which inadmissible, detrimental intermediate positions or intermediate dimensions are set on the positioning and fixing mechanism 14 relative to the jaw distance 12. Conforming to the respective steps or jumps in distance with respect to the jaw distance 12 imparts safety and functional reliability to the ski binding 1, especially to a safety ski binding.

The essential factor is that at least one of the two coupling elements 15, 16 but preferably both coupling elements 15, 16 are provided with at least two rows 21 to 23 of positioning elements 20 oriented parallel with one another. It has proved to be of practical advantage if three mutually parallel rows 21 to 23 are provided, each with several positioning elements 20 disposed one after the other in the binding longitudinal direction 10. This arrangement or structure may also be described as a network or lattice structure with lattice or network threads extending at an acute angle with respect to one another, and the respective positioning elements 20 are positioned at the network points or inter-connecting nodes of this imaginary lattice structure. This pattern with virtual lattice lines extending at an acute angle with respect to the binding longitudinal direction 10 improves the design of the positioning and fixing mechanism 14. In other words, the rows 21 to 23 oriented parallel with one another incorporating positioning elements 20 in the binding longitudinal direction—indicated by arrow 10—are offset from one another, as may best be seen from FIG. 1. An offset distance 24 between adjacent rows 21, 22 respectively 22, 23 of positioning elements 20 is therefore decisive or crucial to a possible or selectable overlap step width between the coupling elements 15, 16. In particular, the size of the offset distance 24 between adjacently lying positioning elements 20 of adjacent rows 21, 22 respectively 22, 23 defines or determines a smallest possible overlap step width or overlap stage for adjusting the jaw distance 12 between the next smaller and next bigger shoe sole length or shoe size.

In the embodiment illustrated as an example, the end portion 17 of the first coupling element 15 is formed by a tapered tab 25, which extends above the end portion 18 of the second coupling element 16. The tab 25, which is virtually an extension of the first coupling element 15 has at least one form-fitting element 26 which can be selectively moved with the differently positioned positioning elements 20 on the second coupling element 16 in a form-fitting connection. As a result, the jaw distance 12 between the jaw bodies 4, 5 is fixed. The required jaw distances 12 are set depending on the choice of form-fitting connection between the form-fitting element 26 and at least one of the positioning elements 20, which in turn depends on the respective shoe sole lengths or shoe sizes.

The tab 25 on the coupling element 15 is preferably mounted so that it can be pivoted about an axis 28 extending perpendicular to a support plane 27 for a sports shoe 2. As a result, the form-fitting element 26 can be selectively moved on the tab 25 with the individual positioning elements 20 in the respective rows 21 to 23 in a form-fitting connection. In particular, the form-fitting element 26 can be moved on the tab 25 or on the coupling element 15 with one of the positioning elements 20 from the middle row 22 or with one of the positioning elements 20 from the rows 21, 23 lying outermost in the form-fitting connection. The offset distance 24 between immediately adjacent positioning elements 20 of different rows 21 to 23 thus defines the smallest possible step width change with respect to the jaw distance 12. This offset distance 24 is preferably approximately 5 mm in order to match steps in the length of shoe soles of approximately 5 mm. The positioning elements 20 of this positioning and fixing mechanism 14 in this instance are provided in the form of a pin-type form-fitting element 26 on the first coupling element 15 and at least one matching complementary element, in particular in the form of a recess or an orifice, with which a form-fitting connection can be made. When the first coupling element 15 or the tab 25 hinge-mounted on it is released, the form-fitting element 26 is disengaged with respect to the relevant positioning element 20 so that the rear jaw body 5 can be moved relative to the front jaw body 4 in its longitudinal guide 6 and set at the desired jaw distance 12. When the tab 25 is lowered or released, its form-fitting element 26 can then engage in a corresponding positioning element 20 again and thus secure the corresponding jaw distance 12 between the two jaw bodies 4, 5. Depending on the respective jaw distance 12 needed, positioning elements 20 of every one of the individual rows 21 to 23 may be selected for a form-fitting co-operation with the first coupling element 15 or with its tab 25. The layout of positioning elements 20 in at least two rows 21 to 23 and the offset of these positioning element rows 21 to 23 in the direction of the binding longitudinal axis—indicated by arrow 10—offers an advantage insofar as relatively large and robust or reliable positioning elements 20 can be provided which are easy to manipulate, even though there is a relatively small overlap step width as regards the overlap width 19 to enable the jaw distance 12 to be adapted to the required shoe size or shoe sole lengths.

FIGS. 3 to 8 illustrate a different embodiment of a central positioning and fixing mechanism 14 for the jaw bodies 4, 5 of a ski binding 1, the same reference numbers being used to denote parts with the same component names as those in the previous drawings. In order to avoid repetition, reference may be made to the detailed description of the preceding drawings.

Figure 5:
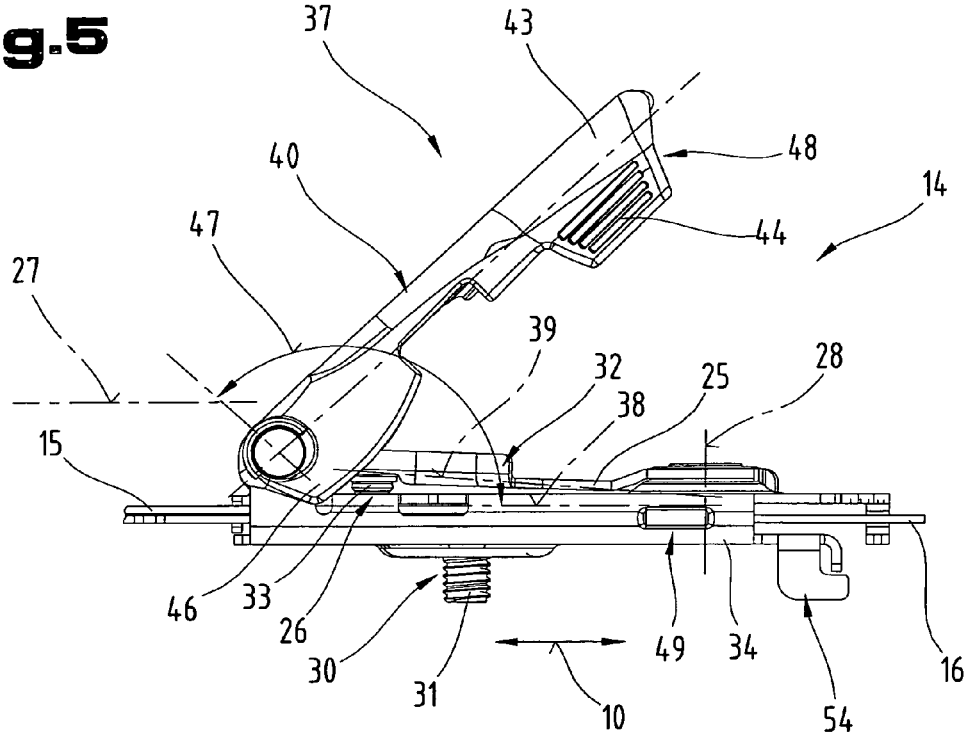
FIG. 5 is a side view of the positioning and fixing mechanism illustrated in FIG. 3.
Figure 6:
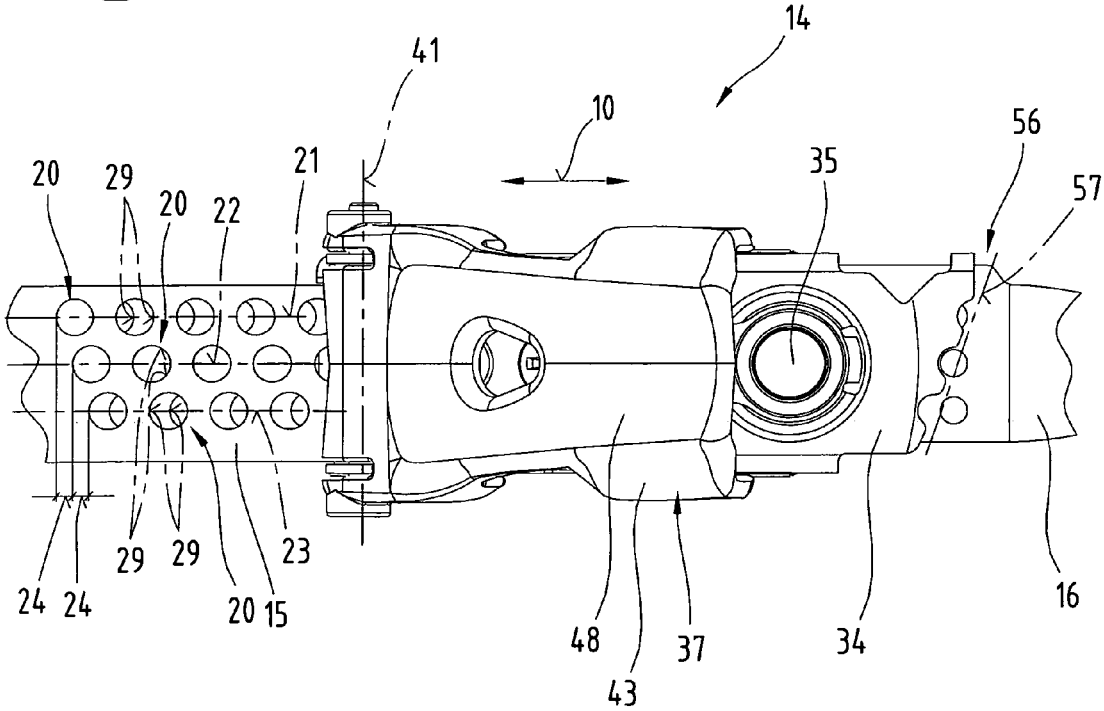
FIG. 6 is a plan view of the positioning and fixing mechanism illustrated in FIG. 3.

In this embodiment, the mutually facing end portions 17, 18 of the two coupling elements 15, 16 of respective rows 21 to 23 are provided with positioning elements 20. In particular, the two end portions 17, 18 of the two coupling elements 15, 16 are provided in the form of perforated plates with a plurality of orifices 29 disposed in a matrix. The positioning elements 20 of the first coupling element 15 and the second coupling element 16 are therefore formed by a plurality of geometrically two-dimensional orifices 29 in the end portions 16, 17 of the plate- or strip-type coupling elements 15, 16. When the positioning and fixing mechanism is in the inactive position—as illustrated in FIG. 5—the coupling elements 15, 16 are able to slide relative to one another in the binding longitudinal direction—indicated by arrow 10.

The positioning and fixing mechanism 14 itself can be fixed by means of at least one fixing means 30 at the desired relative position with respect to the longitudinal direction of a ski 3—FIG. 1. This fixing means 30 is preferably provided in the form of a screw 31, which can be screwed into a matching threaded bore in the ski 3 or into a base plate arrangement for the ski binding 1, enabling the positioning and fixing mechanism 14 to be secured so that it remains stationary and can not be ripped off the sports device, in particular the ski 3. If necessary, the base plate arrangement for the ski binding 1 or the ski 3 itself may have a plurality of mutually spaced adjustable threaded arrangements spaced apart from one another in the binding longitudinal direction—indicated by arrow 10—or an adjustable threaded arrangement in the binding longitudinal direction 10 to enable the positioning and fixing mechanism 14 to be secured in different relative positions and thus enable the jaw unit 4, 5 and the sports shoe 2 of the user to be adapted to suit individual requirements in terms of the standing position on the ski 3.

Figure 8:
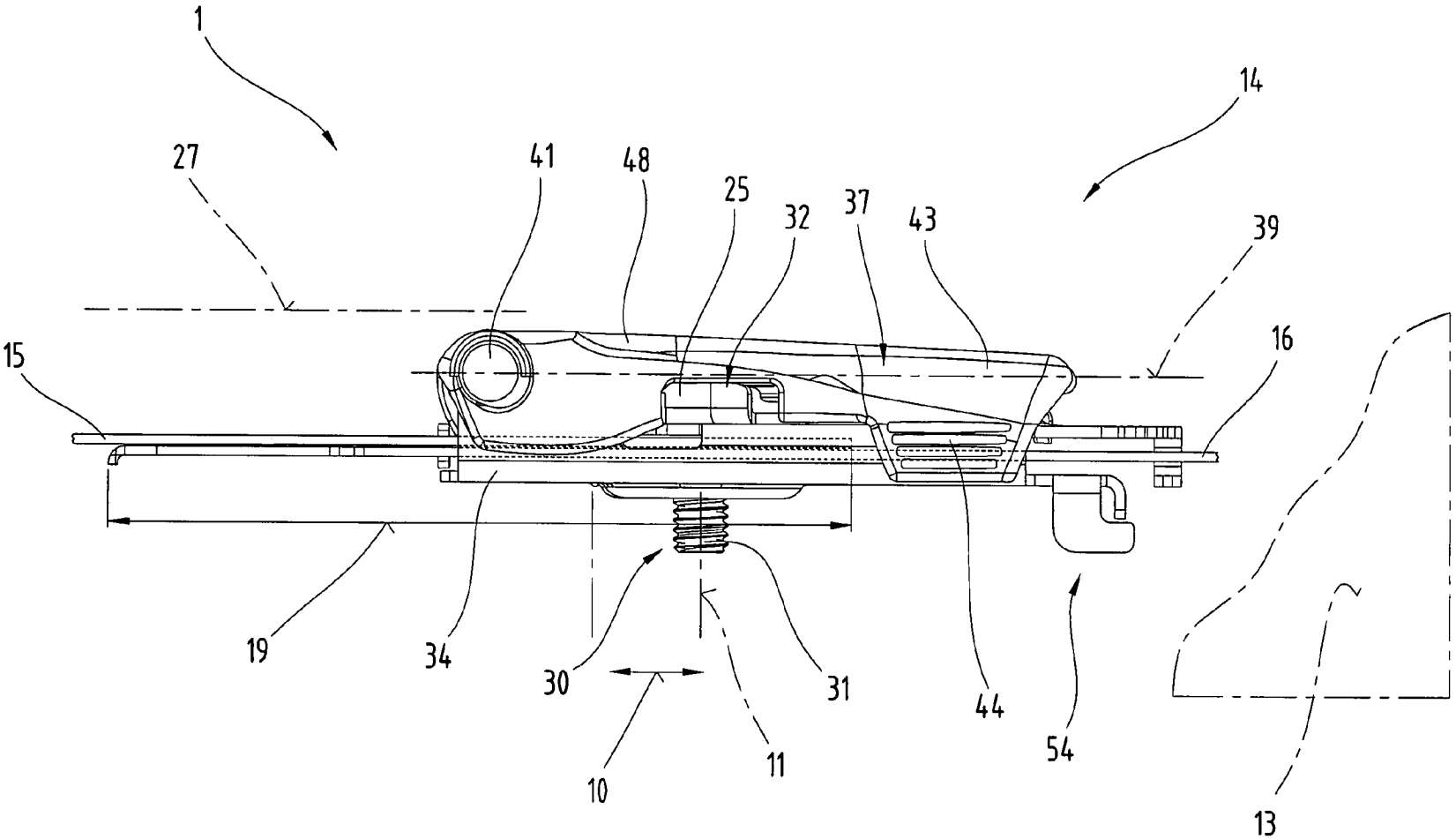
FIG. 8 shows the positioning and fixing mechanism illustrated in FIG. 3 when the position for locking the jaw bodies is assumed.

When the positioning and fixing mechanism 14 is in the active position—illustrated in FIG. 8—all relative displacements between the two coupling elements 15, 16 or between the jaw bodies 4, 5 is prevented. In particular, when the positioning and fixing mechanism 14 is in the active position, the respective required jaw distance 12 is set, because the overlap width 19 set accordingly between the coupling elements 15, 16 is fixed so that there can be no movement. To this end, the positioning and fixing mechanism 14 has at least one fixing element 32, which can be selectively displaced between an active position and at least one inactive position and vice versa. This fixing element 32 essentially corresponds to the tab 25 described above (FIG. 2) with the at least one form-fitting element 26. This fixing element 32 and its form-fitting element 26 can be selectively moved with at least one of the positioning elements 20 on the coupling elements 15, 16 in and out of a form-fitting engagement in order to set different overlap widths 19. A single fixing element 32 is preferably provided, which secures both coupling elements 15, 16 in their respectively set relative position with respect to the central, stationary positioning and fixing mechanism 14. To this end, the fixing element 32 has a bolt or pin 33 which can be engaged in and disengaged from the orifices 29. The rows 21 to 23 on the first coupling element 15 are oriented in alignment with the rows 21 to 23 of positioning elements 20 on the second coupling element 16. In other words, the rows 21 to 23 of orifices 29 are disposed congruently, so that the orifices 29 of the first row 21 of the first coupling element 15 can be moved so that they overlap with the orifices 29 of the first row 21 of the other coupling element 16. The same applies to the orifices 29 in the second or third row 22, 23 of the first coupling element 15 and the second coupling elements 16. The aligned orientation of the individual positioning elements-rows means that with only one fixing element 32, in particular with its pin 33, a form-fitting connection can be activated between the coupling elements 15, 16 on assuming one of a plurality of possible different relative positions. In particular, due to the aligned orientation of the individual rows 21 to 23 on the coupling element 15, 16, the bolt or pin 33 of the fixing element 32 can be engaged and disengaged with respect to two congruent, oppositely lying orifices 29 of the first and the second coupling element 15, 16 so that the bolt or pin 33 either releases both coupling elements 15, 16 so that they are able to move relative to the positioning and fixing mechanism 14 or locks them. In particular, the fixing element 32 or its bolt or pin 33 extends through a selected orifice 29 in the first coupling element 15 and a congruently positioned orifice 29 also selected in the second coupling element 16 in the active position.

The fixing element 32 of the positioning and fixing mechanism 14, which can be displaced and operated as necessary, is preferably forced or pushed into an active position setting the jaw distance 12 due to a resilient elastic design of the fixing element 32 itself and/or by means of a separate spring element, in which the bolt or pin 33 positively engages in two oppositely lying orifices 20 of the plurality of orifices 20 and in this active position—illustrated in FIG. 8—the pin 33 extends transversely through two congruent orifices 29 lying one above the other in the two coupling elements 15, 16. It is of practical advantage if the fixing element 32 is mounted in a tongue-like arrangement, as may best be seen from FIG. 5, and if its material or body is elastically flexible and rebounds so that the bolt or pin 33 can be moved on the fixing element 32 in a direction more or less perpendicular to the support plane 27 for a sports shoe 2 between an active position—FIG. 8—and an inactive position—FIG. 7.

In order to set or obtain several positioning elements-rows 21 to 23 with only one fixing element 32, the fixing element 32 is preferably mounted so that it can be pivoted about an axis 28 extending perpendicular to a support plane 27 for a sports shoe 2. This axis 28 may be defined by a rivet 35 or screw, by means of which the fixing element 32 can be mounted so as to pivot on a housing 34 of the positioning and fixing mechanism 14. This rivet 35 therefore mounts the tongue-like fixing element 32 so that it can pivot relative to the base body or housing 34 of the positioning and fixing mechanism 14. The resilient fixing element 32 therefore stands upright in the manner of a tongue from the rivet 35 constituting the pivot bearing or fixing means.

A pivot range 36 of the fixing element 32 is dimensioned so that the fixing element 32 or its form-fitting element 26 can be selectively moved by an active connection into engagement with the positioning elements 20 in the mutually adjacent rows 21 to 23 of positioning elements 20. By selecting the available pivot range 36 for the fixing element 32 accordingly, therefore, it is possible to achieve and select every individual positioning element 20 depending on the desired or required relative position of the jaw body 4, 5.

Figure 7:
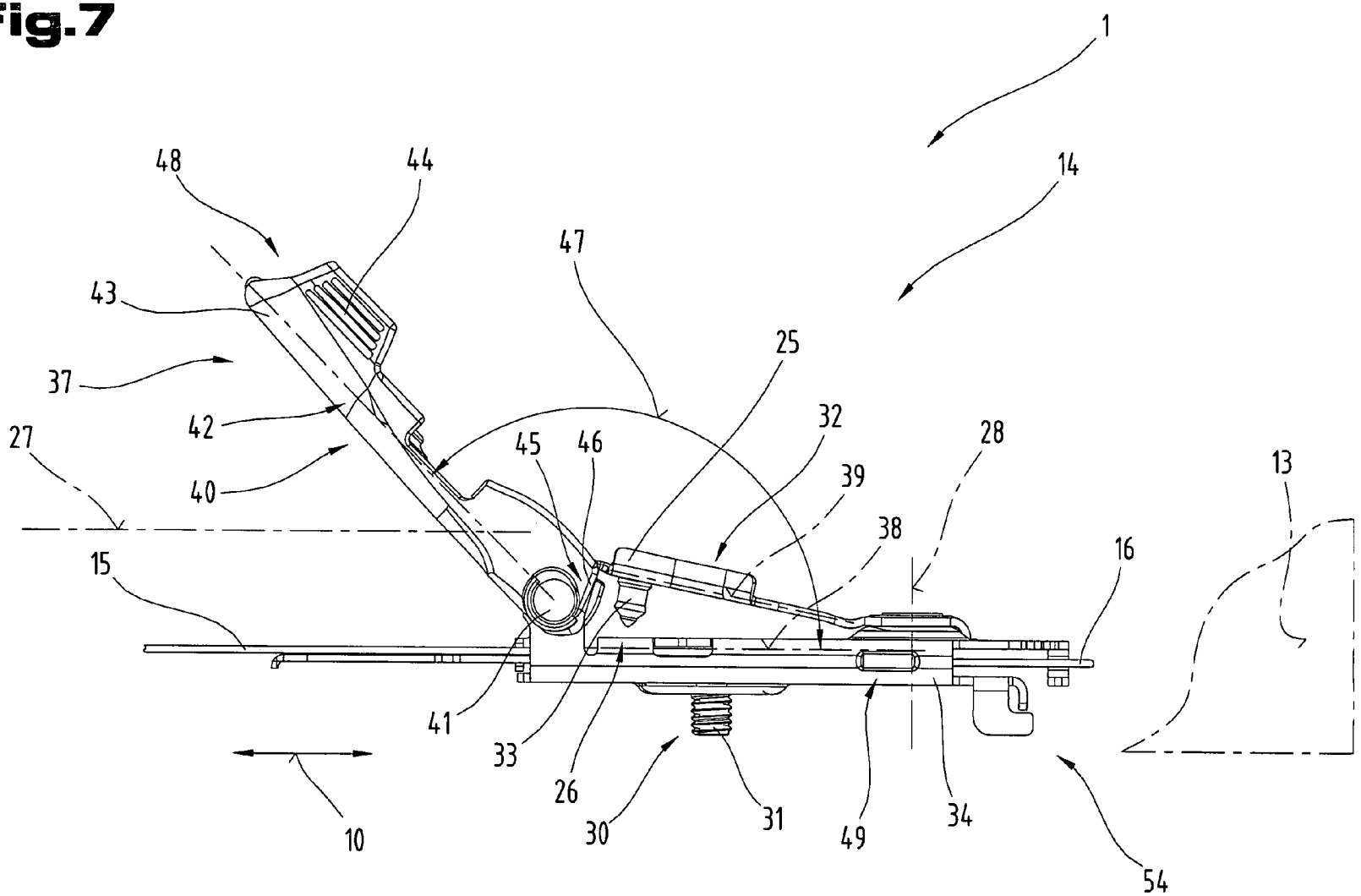
FIG. 7 shows the positioning and fixing mechanism illustrated in FIG. 3 with the operating element pivoted by more than 90°.

The fixing element 32, which is therefore used as a means of mechanically locking and releasing the relative positions of the coupling elements 15, 16 and the jaw bodies 4, 5 connected to them, is preferably provided with an operating element 37, by means of which the fixing element 32 can be transferred, at least starting from its active position 38—FIG. 8—into its or into one of its inactive positions 39—FIG. 7. This operating element 37 for the user or operator of the ski binding 1 thus makes it easier to manipulate the positioning and fixing mechanism 14. In particular, this operating element 37 offers comfortable and easy operation of the respective functions of the positioning and fixing mechanism 14.

The advantage of this is that the operating element 37, provided in the form of a two-armed lever 40, is mounted so that it can pivot about a pivot axis 41 extending substantially parallel with the support plane 27 and preferably transversely to the binding longitudinal direction—arrow 10. A first, relatively longer lever arm 42 of the operating element 37 is therefore designed as a handle 43 which can be held or gripped by the user. This handle 43 may be provided with an anti-slip gripping surface 44 for ergonomic operation. The second, relatively shorter lever arm 45 of the operating element 37 is designed as a positioning arm 46 for the fixing element 32, to enable the fixing element 32 to be transferred starting from an active, form-fitting, coupling position into an inactive position in which the coupling elements 15, 16 are released so that they are able to move.

The lever 40 with the two lever arms 42, 45 and the pivot axis 41 fixedly disposed on the housing 34 is therefore preferably provided in the form of a bent or angled lever 40. In particular, the first lever arm 42 and the second lever arm 45 subtend an angle of less than 180°, preferably an angle of approximately 90°. With a view to making use of leverage laws, a length of the first lever arm 42 provided as a handle 43 is a multiple of the length of the second lever arm 45 provided as a positioning arm 46. This ensures that, in spite of the strong locking or spring forces which force the fixing element 32 into the locking position and retain it in the locking position, the locked position can be effortlessly and comfortably deactivated by means of the operating element 37.

A pivot range 47 of the operating element 37 about its pivot axis 41 is preferably more than 90° so that the fixing element 32 can be moved between its active position 38 and its inactive position 39. The operating element 37, in particular its positioning arm 46, preferably engages under the free end of the fixing element 32, i.e. the one remote from the axis 28. The form-fitting element 26 or the pin 33 is also disposed in the free or freelying end portion of the fixing element 32, whereas the axis 28 enabling the fixing element 32 to pivot within a horizontal plane is positioned in the oppositely lying end portion.

It is of practical advantage if the operating element 37 is oriented essentially parallel with the support surface 27 when the fixing element 32 is in the active position 38. As a result, the longitudinally extending or elongate handle 43 is specifically oriented essentially parallel with the binding longitudinal direction—arrow 10.

When the fixing element assumes the inactive position 39, on the other hand, the operating element 37 is oriented at an angle, in particular an angle of more than 90° with respect to the support plane 27. Accordingly, the operating element 37 and its handle 43 sit in a very pronounced upright position from the support plane 27 for a sports shoe 2.

In one advantageous embodiment, the operating element 37 for the fixing element 32 is simultaneously designed as a cover element 48 for the positioning and fixing mechanism 14. In particular, when the positioning and fixing mechanism 14 is in the active position, i.e. in the state ready for operating the ski binding 1, the operating element 37 designed as a cover element 48 at least partially overlaps the positioning and fixing mechanism 14, in particular its fixing element 32. This cover element 48 may have a substantially U-shaped cross-section for this purpose and is mounted so that it covers at least some portions of the top face and some portions of the side faces of the positioning and fixing mechanism 14 when the cover element 48 is oriented essentially parallel with the binding longitudinal direction—arrow 10. When the positioning and fixing mechanism 14 is in the locked position, its operating element 37 and fixing element 32 are oriented essentially parallel with one another.

Figure 3:
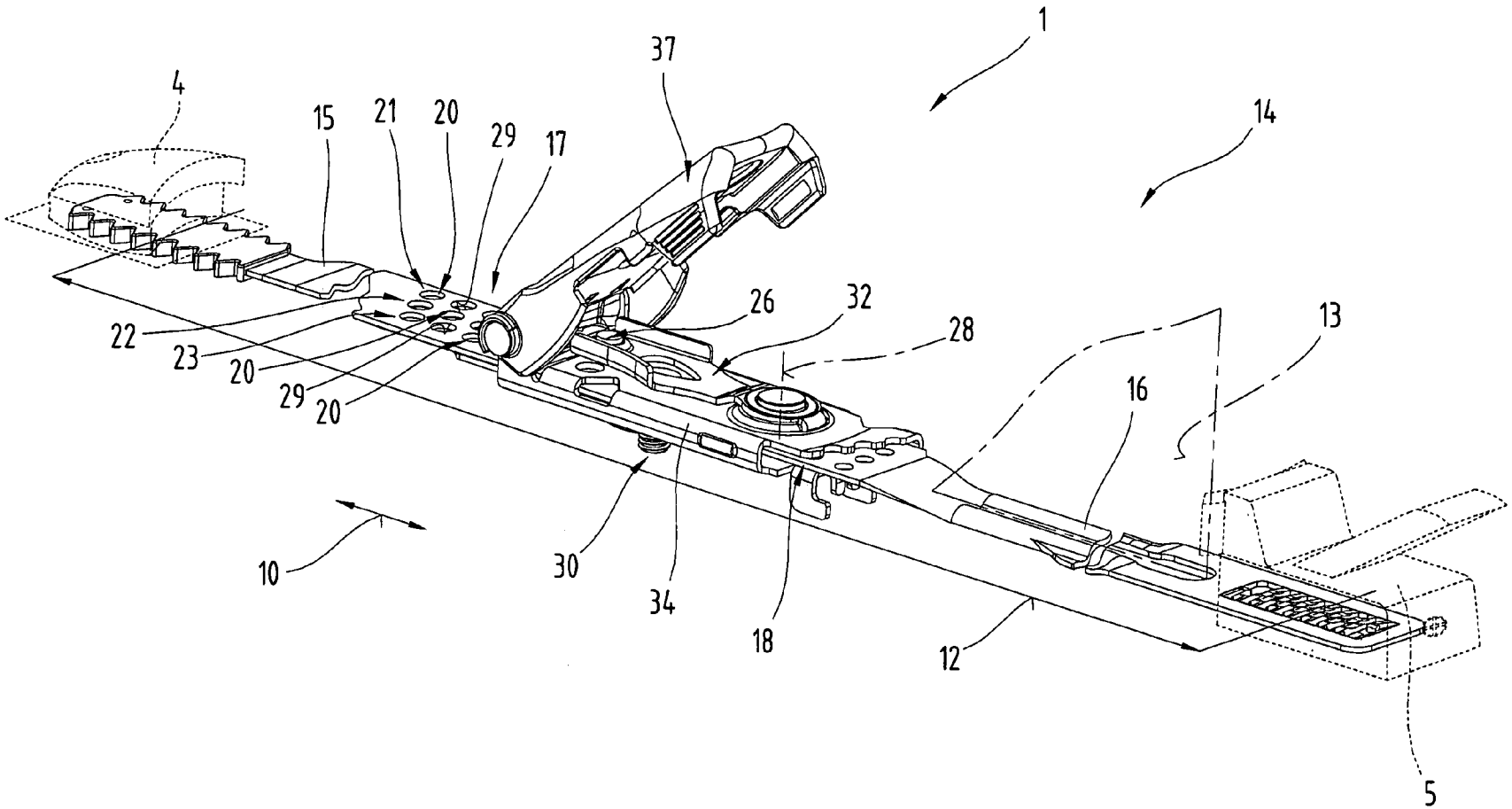
FIG. 3 is a perspective diagram illustrating another embodiment of a positioning and fixing mechanism for the jaw bodies of a ski binding.
Figure 4:
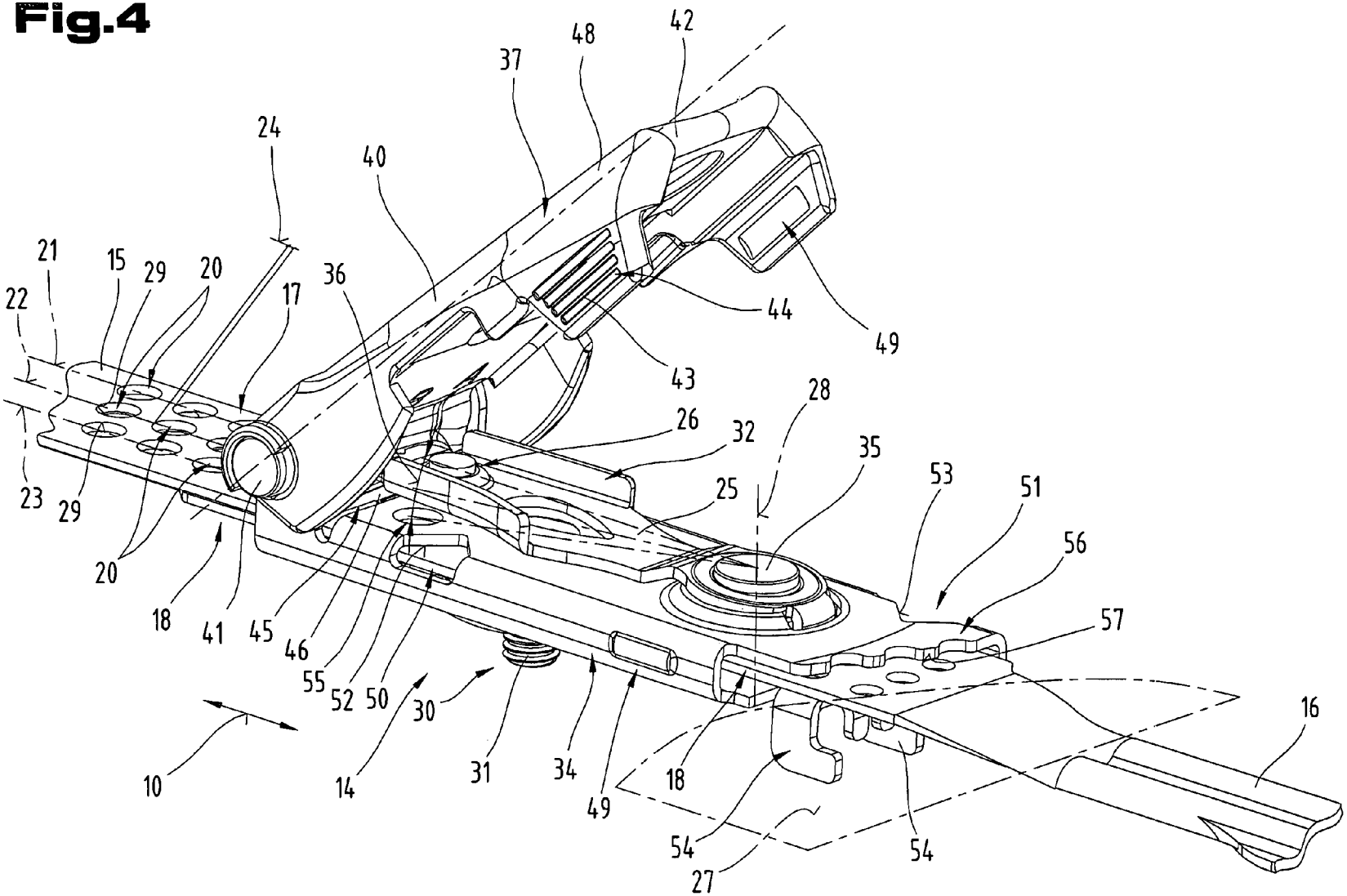
FIG. 4 is a diagram on a larger scale showing the positioning and fixing mechanism illustrated in FIG. 3.

As may best be seen from FIG. 7, a vertical length of the bolt or pin 33 on the fixing element 32 may be dimensioned such, or a pivot bearing on the housing 34 of the positioning and fixing mechanism 14 constituting a pivot axis 41 for the operating element 37 may be positioned such that the operating element 37 can not be completely closed (see FIG. 8) or can not be pivoted below the support plane 27 for a sports shoe 2 unless the fixing element 32 is disposed in its active position 38 locking the coupling elements 15, 16. This will be the case when the form-fitting element 26, in particular the pin 33, is in engagement with at least one or with at least two oppositely lying positioning elements 20. Otherwise, the end of the tongue-like fixing element 32 standing upwards will prevent the cover-type operating element 37 from being completely closed, preventing a connection or coupling of the sports shoe 2 with the ski binding 1 or with the ski 3. This type of design of the positioning and fixing mechanism 14 is particularly practical in terms of guaranteeing safe use of the ski binding 1 (FIG. 3).

Between the base part or housing 34 of the positioning and fixing mechanism 14 and the pivotably mounted operating element 37, a snap-fit connection 49 is preferably provided, which retains the operating element 37 in an essentially plane-parallel orientation with respect to the housing 34 by means of a retaining force which is limited but can be overcome by hand. This snap-fit connection 49 specifically ensures that the operating element 37 remains in a defined initial or non-operating position when the ski binding 1 is in use. The snap-fit connection 49 is preferably provided in the form of matching raised areas and recesses or by mutually engaging elements on the housing 34 and on the cover element 48 or on the operating element 37.

The base element or housing 34 of the positioning and fixing mechanism 14 is of an essentially U-shaped or rectangular design in cross-section, i.e. transversely to the binding longitudinal direction 10, and the end portions 17, 18 of the coupling elements 15, 16 extend through the open terminal ends of the housing 34. The housing 34 preferably provides a mount for the operating element 37 and the fixing element 32 on its top face. Also provided on the housing 34 is at least one display window 50, 51 or an equivalent marker for a length or spacing scale. Recesses 52, 53 are preferably provided on oppositely lying peripheral portions, in particular on the lateral peripheral portions or on the terminal ends of the housing 34, constituting display windows 50, 51, thereby affording a view onto the first coupling element 15 at one side and onto the second coupling element 16 at the other side. In particular, two mutually spaced display windows 50, 51 or markers are provided, in which case the first display window 50 permits sight of a scale on the first coupling element 15 and the display window 51 spaced apart from it or lying opposite affords a view of a scale on the second coupling element 16. In particular, the relative position of the first coupling element 15 with respect to the positioning and fixing mechanism 14 can be set and controlled via the first display window 50, and the relative position of the second coupling element 16 and the rear jaw body 5 (FIG. 1) with respect to the positioning and fixing mechanism 14 can be adjusted or controlled via the second, separately positioned display window 51 or display element. As soon as the respective coupling elements 15, 16 have been adjusted relative to the housing 34 or relative to the display windows 50, 51 on the basis of the respective desired values, the fixing element 32 can be transferred to its active position 38 in which it extends through two congruently lying orifices 20 one above the other within a common row 21 to 23 by means of the bolt or pin 33 and thus prevents any relative displacement of the two coupling elements 15, 16 relative to the housing 34.

Standing proud of the bottom face of the housing 34 is at least one fixing means 30, preferably in the form of a screw 31, to enable the housing 34 of the positioning and fixing mechanism 14 to be permanently fitted to the ski. The housing 34 may optionally be provided with at least one additional locking projection 54, which is able to engage in a matching recess in the base plate of the ski binding 1 or in a recess of the ski 3 (FIG. 1), thereby ensuring that the positioning and fixing mechanism 14 is retained in the binding longitudinal direction—indicated by arrow 10—even if the fixing means 33 provided in the form of a screw 31 becomes loose or is missing. In particular, the locking projection 54 on the bottom face of the housing 34 represents a functionally redundant fixing means or fixture of the positioning and fixing mechanism 14 on a ski 1.

In order to increase the strength of the fixing element 32 and to increase the robustness of the pin 33 on the bottom face of the fixing element 32, a plurality of guide bores 55 matching the pin 33 may be provided for the pin 33 on the top face and optionally also on the bottom face of the housing 34. These individual guide bores 55 for the pin 33 are then congruent with the individual rows 21 to 23 if the support plane 27 is viewed from above. The number of these guide bores 55 corresponds to the number of rows 21 to 23 on the top and/or bottom face of the housing 34. These guide bores 55 are also disposed in an arc and the center part of this arc lies on the axis 28 for the fixing element 32. Instead of providing several mutually spaced guide bores 55, it would naturally also be possible to provide an arcuately shaped guide bore on the top face of the housing 34 in order to increase the strength of the pin with the aid of the wall surfaces of this elongate guide bore and thus increase the maximum amount of stress which the fixing element 32 can withstand as well as the locking forces of the positioning and fixing mechanism 14.

It is also of advantage if a positioning means 56 is provided on at least one end face of the housing 34. This positioning means 56 makes it easier to make the correct or desired adjustment of the coupling element 15, 16 at the respective relative positions required. The positioning means 56 is preferably provided in the form of a sloped region 57 in a terminal end portion of the housing 34. This sloped region 57 serves as an orientation aid for those relative positions in which the coupling elements 15, 16 are adjusted so that they can be easily connected to one another via the fixing element 32, in particular via its pin 33, and locked relative to the housing 34.

Figure 9:
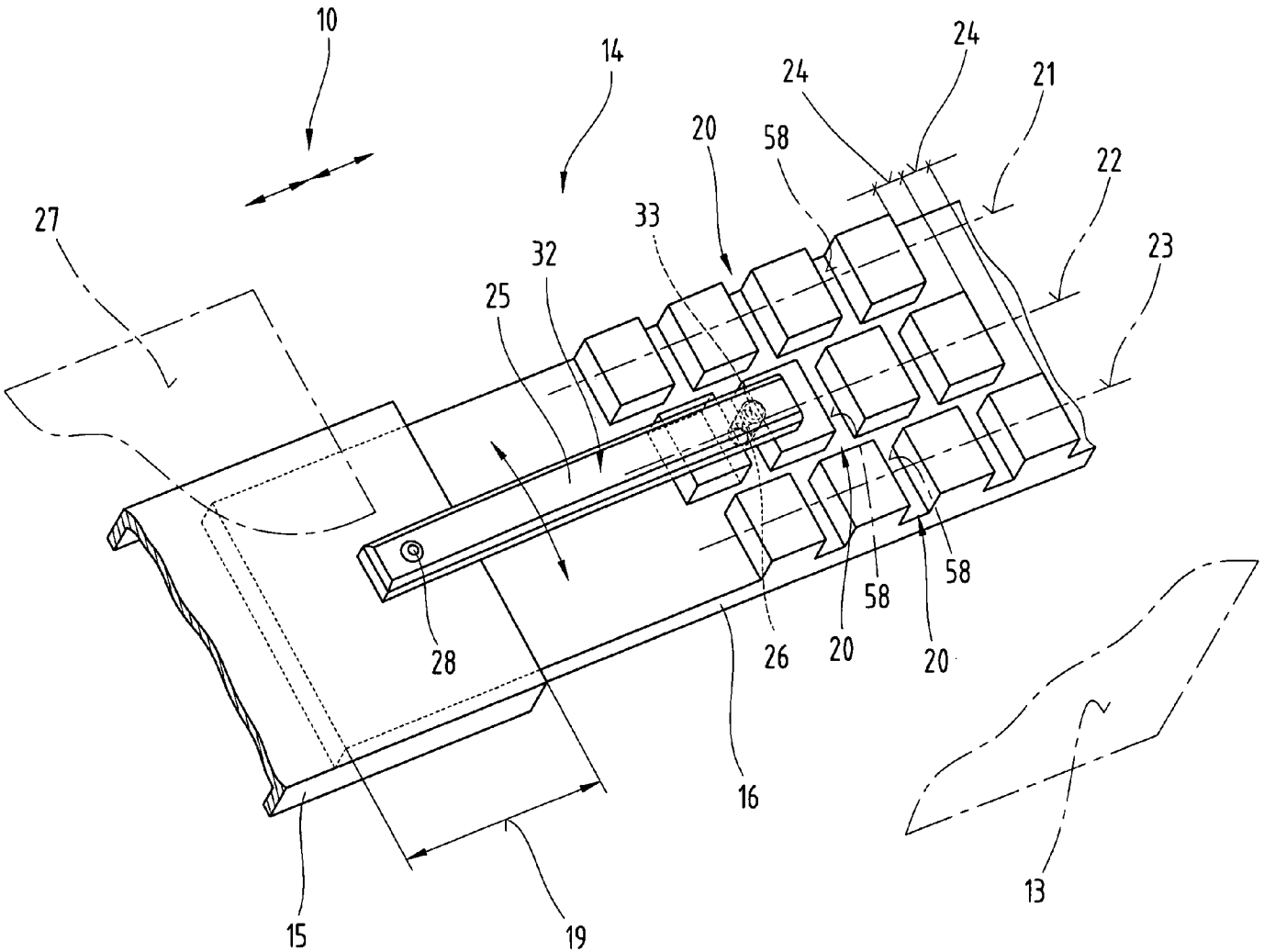
FIG. 9 is a highly simplified, perspective diagram of another embodiment of the positioning and fixing mechanism.

FIG. 9 illustrates another embodiment of a positioning and fixing mechanism 14 for the jaw bodies 4, 5 of a ski binding 1 (FIG. 1). Parts already described are denoted by the same reference numbers and the descriptions given above apply to the same parts denoted by the same reference numbers.

Again, the mutually facing end portions 17, 18 of the two coupling elements 15, 16 are arranged overlapping, lying one above the other. One of the coupling elements 15, 16—in the example illustrated coupling element 15—has the tab-type fixing element 32 with the form-fitting element 26, which can be moved selectively with one of the positioning elements 20 of the plurality of positioning elements 20 on the other coupling element 16 into and out of a form-fitting connection. The positioning elements 20 on the coupling element 16 are provided in the form of a plurality of recesses 58 in which the form-fitting element 26 of the fixing element 32 can selectively engage in order to set different overlap widths and different relative positions of at least one of the jaw bodies 4, 5 relative to the centrally disposed fixing and positioning mechanism 14. Again, these recesses 58 and the raised areas lying between the recesses 58 are arranged in at least two mutually parallel rows 21 to 23. These rows 21 to 23 extending in the binding longitudinal direction 10 are disposed offset from one another by reference to the binding longitudinal direction 10 by a defined offset distance 24. This enables relatively small overlap step widths to be obtained whilst nevertheless providing relatively large or strong positioning elements 20 which can be selected and activated effortlessly.

In the embodiment illustrated as an example, the coupling element 15, which has an essentially U-shaped cross-section, extends congruently or telescopically above the coupling element 16 lying underneath with the two-dimensional, geometrically defined, arrangement of three rows of positioning elements 20, which are thus provided in the form of recesses 58 in the coupling element 16.

The embodiments illustrated as examples represent possible design variants of the ski binding 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the ski binding 1, it and its constituent parts are illustrated to a certain extent out of scale and/or on an enlarged scale and/or on a reduced scale.

Above all, the individual embodiments of the subject matter illustrated in FIGS. 1, 2; 3, 4, 5, 6, 7, 8; 9 constitute independent solutions proposed by the invention in their own right. The objectives and associated solutions proposed by the invention may be found in the detailed descriptions of these drawings.

LIST OF REFERENCE NUMBERS

1 Ski binding
2 Sports shoe
3 Ski 25 Tab
4 Jaw body
5 Jaw body

6 Sole holder
7 Sole holder
8 Longitudinal guide
9 Longitudinal guide
10 Arrow
11 Locking position
12 Jaw distance
13 Vertical plane
14 Positioning and fixing mechanism
15 Coupling element
16 Coupling element
17 End portion
18 End portion
19 Overlap width
20 Positioning element
21 Row
22 Row
23 Row
24 Offset distance
25 Tab
26 Form-fitting element
27 Support plane
28 Axis
29 Orifice
30 Fixing element
31 Screw
32 Fixing element
33 Pin
34 Housing
35 Rivet
36 Pivot range
37 Operating element
38 Active position
39 Inactive position
40 Lever
41 Pivot axis
42 Lever arm
43 Handle
44 Gripping surface
45 Lever arm
46 Positioning arm
47 Pivot range
48 Cover element
49 Snap-fit connection
50 Display window
51 Display window
52 Recess
53 Recess
54 Locking projection
55 Guide bore
56 Positioning means
57 Sloped region
58 Recess What is clamed is:

1. A ski binding, with guide elements which can be mounted or pre-fitted on a ski in the binding longitudinal direction, for a front and a rear jaw body, which jaw bodies are designed to retain the front and rear end portions, respectively, of a sports shoe, comprising a first coupling element connected to the front jaw body and a second coupling element connected to the rear jaw body, and mutually facing end portions of these coupling elements co-operate with a positioning and fixing mechanism disposed between the jaw bodies in order to adjust and retain the jaw body as necessary by reference to the binding longitudinal direction, and the mutually facing end portions of the coupling elements are disposed to overlap, and an overlap width between the two coupling elements can be varied to make an individual adjustment for different jaw distances, and the end portions of the coupling elements have a plurality of positioning elements for making a stepped change to the overlap width, wherein when viewed from above onto a support plane for a sport shoe, at least two mutually parallel rows of positioning elements are provided on the first and on the second coupling element, in each instance, wherein the individual positioning element-rows on the two coupling elements are oriented in alignment with one another, and the positioning element-rows per coupling element are disposed offset from one another in the binding longitudinal direction, and an offset distance between adjacent rows of positioning elements represents a step dimension for an overlap step width between the coupling elements, and wherein the positioning elements are provided in the form of a plurality of perforations in the mutually facing end portions of the coupling elements.

2. The ski binding as claimed in claim 1, wherein the positioning and fixing mechanism has at least one fixing element which can be selectively moved into and out of a form-fitting engagement with at least one of the positioning elements.

3. The ski binding as claimed in claim 2, wherein the fixing element has a bolt or pin which can be moved into and out of engagement with respect to the systematic layout of orifices in the two coupling elements.

4. The ski binding as claimed in claim 2, wherein, in its active position, the fixing element extends through an orifice in the first coupling element and a congruently positioned orifice in the second coupling element.

5. The ski binding as claimed in claim 2, wherein the fixing element of the positioning and fixing mechanism is forced due to a resilient design or by means of a spring element into an active position setting the jaw distance, in which the bolt or pin engages in a selected orifice of the first and the second coupling elements.

6. The ski binding as claimed in claim 2, wherein the fixing element is mounted in a tongue-type arrangement and is of a resiliently elastic design, and its bolt or pin is displaceable in a direction perpendicular to a support plane for a sports shoe between an active position and an inactive position.

7. The ski binding as claimed in claim 2, wherein the fixing element is mounted so as to be pivotable about an axis extending perpendicular to a support plane for a sports shoe.

8. The ski binding as claimed in claim 7, wherein a pivot range of the fixing element is dimensioned so that the fixing element can be moved into selective engagement in an active connection with positioning elements in the mutually adjacent rows of positioning elements.

9. The ski binding as claimed in claim 1, wherein the fixing element is provided with an operating element by means of which the fixing element can be transferred starting from its active position into an inactive position.

10. The ski binding as claimed in claim 9, wherein the operating element is provided in the form of a two-armed lever which is mounted so as to be pivotable about a pivot axis extending essentially parallel with a support plane for a sports shoe.

11. The ski binding as claimed in claim 10, wherein a first lever arm of the operating element is designed as a handle and a second lever arm of the operating element is provided in the form of a positioning arm for the fixing element.

12. The ski binding as claimed in claim 10, wherein a pivot range of the operating element for moving the fixing element between its active position and its inactive position is more than 90°.

13. The ski binding as claimed in claim 9, wherein when the fixing element is in the active position, the operating element is oriented essentially parallel with a support plane for a sports shoe and parallel with the binding longitudinal direction.

14. The ski binding as claimed in claim 9, wherein when the fixing element is in the inactive position, the operating element is oriented at an angle with respect to a support plane for a sports shoe.

15. The ski binding as claimed in claim 9, wherein the operating element is designed as a cover element for the positioning and fixing mechanism and this cover element covers at least parts of the positioning and fixing mechanism when the fixing mechanism is in the active position.

16. The ski binding as claimed in claim 1, wherein a housing of the positioning and fixing mechanism can be selectively fixed in the binding longitudinal direction at one of several possible positions.

17. The ski binding as claimed in claim 1, wherein at least one display window or a marker is provided on the positioning and fixing mechanism in order to display the respective jaw distance.

18. The ski binding as claimed in claim 1, wherein the positioning and fixing mechanism is provided with a first display window for displaying the relative position of the first coupling element and another second display window spaced at a distance apart from it for displaying the relative position of the second coupling element.

19. The ski binding as claimed in claim 1, wherein a scale is provided respectively in the mutually facing end portions of the first coupling element and the second coupling element for displaying the jaw distance of the jaw bodies from one another or for displaying the distances of the jaw bodies relative to the positioning and fixing mechanism.

20. The ski binding as claimed in claim 1, wherein a housing of the positioning and fixing mechanism is provided with an essentially U-shaped or rectangular cross-section and the coupling elements are disposed between the lateral legs of the housing extending parallel with the binding longitudinal direction.

21. The ski binding as claimed in claim 3, wherein the bolt or pin projects substantially perpendicular from the bottom face of the fixing element and is guided in an arcuately shaped guide bore or in matching guide bores disposed in an arc-shaped pattern in the top face of the housing of the positioning and fixing mechanism.

22. The ski binding as claimed in claim 1, wherein the coupling elements are disposed one above the other in their overlapping portion.

23. The ski binding as claimed in claim 3, wherein a vertical length of the bolt or pin on the fixing element is dimensioned such, or a pivot bearing with a pivot axis for the operating element can be positioned on a housing of the positioning and fixing mechanism in such a way that the operating element can not be completely closed or can not be pivoted below the support plane for a sports shoe unless the fixing element is disposed in its active position locking the coupling elements.

* * * * *